United States Patent [19]

Nishiki et al.

[11] Patent Number: 4,927,800

[45] Date of Patent: May 22, 1990

[54] ELECTRODE CATALYST AND METHOD FOR PRODUCTION THEREOF

[75] Inventors: Yoshinori Nishiki; Shuji Nakamatsu, both of Kanagawa; Takayuki Shimamune, Tokyo, all of Japan

[73] Assignee: Permelec Electrode Ltd., Kanagawa, Japan

[21] Appl. No.: 276,703

[22] Filed: Nov. 28, 1988

[30] Foreign Application Priority Data

Nov. 27, 1987 [JP] Japan ..... 62-297673

[51] Int. Cl.[5] ..... B01J 23/00

[52] U.S. Cl. ..... 502/349; 204/56.1; 204/290 R; 204/291; 204/294; 204/282

[58] Field of Search ..... 204/56.1, 282, 290 R, 204/283, 291, 294, 296, 20, 21; 502/349

[56] References Cited

U.S. PATENT DOCUMENTS

| | | | |
|---|---|---|---|
| 4,026,786 | 5/1977 | Fukubayashi et al. | 204/291 |
| 4,064,035 | 12/1977 | Fukasawa | 204/291 |
| 4,316,782 | 2/1982 | Foller et al. | 204/129 |
| 4,510,034 | 4/1985 | Ohshima et al. . | |

FOREIGN PATENT DOCUMENTS

| | | |
|---|---|---|
| 2133729 | 12/1972 | France . |
| 3223196 | 9/1988 | Japan . |
| 1378703 | 12/1974 | United Kingdom . |

OTHER PUBLICATIONS

Patent Abstracts of Japan, p. 35C476, JP-A-62 197115.

*Primary Examiner*—John F. Niebling
*Assistant Examiner*—Kathryn Gorgos
*Attorney, Agent, or Firm*—Sughrue, Mion, Zinn, Macpeak & Seas

[57] ABSTRACT

An electrode catalyst comprising a lead dioxide electrically deposited layer, the layer having particles containing $\beta$-lead dioxide powder dispersed therein, and a method for producing the electrode catalyst are disclosed. The particles contain $\beta$-lead dioxide powder and optionally an electrolytic cocatalyst selected from PTFE, agar, gelatin, a perfluoro ion exchange resin and the like. The present electrode catalyst is useful for production of ozone by electrolysis of water and for production of peroxides by electrolysis of aqueous solutions.

16 Claims, No Drawings

ELECTRODE CATALYST AND METHOD FOR PRODUCTION THEREOF

FIELD OF THE INVENTION

The present invention relates to an electrode catalyst for electrolysis and a method for the production thereof, which is useful for electrolytic oxidation reactions at high electric potentials including production of ozone by the electrolysis of water, production of peroxides by electrolysis of aqueous solutions and electrolytic oxidation of organic material.

BACKGROUND OF THE INVENTION

The recent trend in the electrolytic industry is to employ an electrode comprising a substrate having high stability under anode conditions, e.g., titanium and titanium alloys, coated with an electrode catalyst substance, particularly the oxides of the platinum group metals, in place of soluble electrodes as exemplified by carbon. This electrode, called a dimensionally stable anode (DSA) or a dimensionally stable electrode (DSE), is used in a variety of industrial electrolytic processes including production of oxygen gas by electrolysis of water and production of halogen or alkali hydroxide by electrolysis of an aqueous solution of metal halide, because of its excellent electrolytic characteristics and durability, as described in U.S. Pat. Nos. 3,711,385 and 3,632,498.

The anode substance plays an important role in production of ozone gas and peroxides utilizing the anodic electrolytic reaction and in organic electrolysis. In the electrolytic reaction for the production of ozone gas, the electric potential is high, and even if DSA is used, low potential electrolytic reactions predominate. Thus, DSA is unsuitable for the electrolytic production of ozone gas, and only a titanium electrode coated with platinum is utilized.

In the electrolysis for the production of ozone gas, an anodic catalytic substance which can be used in place of DSA with an increase in the efficiency of operation is needed. Thus, various investigations have been made not only in regard to electrode catalysts but also with respect to the electrode and cell structure where lead, lead oxide, carbon, etc. are used as electrode substances, as *J. Elec. Chem. Soc.*, 132 p. 367 ff. (1985) and U.S. Pat. No. 4,416,747.

In the use of an electrode containing lead dioxide for the production of ozone, durability and mechanical strength of the electrode are poor and the lead dioxide electrode catalyst has a relatively high electrolytic voltage which increases the amount of electric power consumed.

The present inventors have proposed various improvements of the lead dioxide-coated electrode. However, the improved electrodes previously proposed by the present inventors are still not satisfactory in that a decrease in electrolytic voltage ascribable to the efficiency of the catalyst itself was insufficient, while an increase in current efficiency could not be achieved because the material to be electrolyzed in an electrolytic solution is not in sufficient contact with the active substance on the electrode. Furthermore, if the electrode active substance is too dense, gas is drawn insufficiently resulting in a higher electrolytic voltage.

SUMMARY OF THE INVENTION

An objective of the present invention is to provide a lead dioxide electrode catalyst having the desired activity and lower electrolytic voltage, and a method for the production thereof.

The present invention relates to an electrode catalyst comprising as lead dioxide electrically deposited layer having fine particles containing $\beta$-lead dioxide powder dispersed therein.

The present invention also relates to an electrode catalyst comprising a substrate for electric deposition and a lead dioxide electrically deposited layer having fine particles containing $\beta$-lead dioxide powder dispersed therein.

The present invention relates to a method for producing the electrode catalyst which comprises electrolyzing a substrate for electric deposition in an aqueous lead nitrate solution having fine particles containing $\beta$-lead dioxide powder suspended therein to form a lead dioxide electrically deposited layer on the substrate, the layer having particles containing $\beta$-lead dioxide powder dispersed therein, and then separating the lead dioxide electrically deposited layer from the substrate for electric deposition.

The present invention also relates to a method for producing the electrode catalyst which comprises electrolyzing a substrate for electric deposition in an aqueous lead nitrate solution having fine particles containing $\beta$-lead dioxide powder suspended therein to form a lead dioxide electrically deposited layer on the substrate, the layer having particles containing $\beta$-lead dioxide powder dispersed therein.

DETAILED DESCRIPTION OF THE INVENTION

The present invention is based on finding that a lead dioxide catalyst layer formed by electrodeposition on a substrate has a higher strength and operates at a lower electrolytic voltage as compared to a lead dioxide catalyst layer on a substrate formed by a conventional technique such as the hot press method.

The lead dioxide catalyst layer formed by the electrodeposition of the present invention is denser than a lead dioxide catalyst formed by the conventional hot press method and thus the strength of the catalyst itself is increased. Furthermore, by incorporating $\beta$-lead dioxide powder into the catalyst, gas removal is enhanced and the electrolytic voltage is decreased while strength of the catalyst is maintained.

The electrode catalyst of the present invention is formed by electrically depositing a layer of lead dioxide on a substrate surface. Substrates that may be used in the present invention include those conventionally used as an electrode substrate such as valve metals (e.g., titanium, zirconium, niobium and tantalum) and alloys thereof, which are suitable for use in the form of plate, bar and porous mesh and which are easy to handle and have good durability. These substrates are used as a unitary assembly with the electrode catalyst layer.

In the present invention, an ion exchange membrane which is a solid polymer electrolyte (SPE) (e.g., fluorinated hydrocarbon resin-based ion exchange membranes) and various electricity collectors can also be used for the substrate. In the case, electricity collectors having an attached catalyst layer and SPE electrodes can be formed by a single step, and thus, an operation of separately forming an electrode catalyst and then fixing it on the membrane or electricity collector, as is conventionally performed, may be omitted.

In the present invention, as the substrate, various fine particles acting as nuclei for the growth of lead dioxide electrically deposited layer can also be used. Catalyst particles formed in this manner can be used as catalysts for various reactions. In addition, after the formation of the lead dioxide electrically deposited layer on a suitable substrate, the catalyst layer may be peeled apart from the substrate and used as such in various reaction.

Non-limiting conditions in the electrodeposition for formation of the lead dioxide layer onto the substrates are as follows: a 300 to 500 g/l aqueous lead nitrate solution may be used as an electrolytic solution, and the electrodeposition may be carried out at a temperature of 40° to 60° C., a liquid pH of not more than 3 and a current density of 1 to 10 A/dm$^2$. Under such conditions, $\beta$-lead dioxide is mainly electrically deposited on the substrate.

The lead dioxide electrically deposited layer formed by the above electrodeposition process contains fine particles which are composed mainly of $\beta$-lead dioxide powder. The $\beta$-lead dioxide has inherent catalytic activity, has good corrosion resistance in various solutions such as strong acids (e.g., sulfuric acid) and further has excellent electrical conductivity about $10^{-4}$ $\Omega$cm). The $\alpha$-lead dioxide is unsuitable because it is inferior in corrosion resistance and electrical conductivity to $\beta$-lead dioxide.

The $\beta$-lead dioxide fine particle diameter are not particularly limited in the present invention, but the particle diameter is preferably smaller than that passing through 100 mesh (Tyler mesh; hereafter the same), i.e., 150 $\mu$ or less, so as to obtain a firm surface. In the case of particles having a particle diameter smaller than that passing through 345 mesh, i.e., 40 $\mu$ or less, it is preferred that the smaller particles hot constitute more than 50% of the total weight of particles. If the proportion of the particles having a particle diameter smaller than about 40 $\mu$ is greater than 50%, firmness is increased at the expense of porosity.

The dispersed fine particles in the lead dioxide electrically deposited layer generally contain not less than 20 wt % of $\beta$-lead dioxide powder, and they may consist of $\beta$-lead dioxide powder. Depending on its use, an electrolytic cocatalyst can be contained as the dispersed fine particles, such as a fluorine resin (e.g., polytetrafluoroethylene (PTFE)), agar, gelatin, a perfluoro ion exchange resin, carbon fluoride, carbon, and oxides of at least one of titanium, zirconium, niobium and tantalum. For example, particles of a fluorine resin, a perfluorosulfonic acid-type ion exchange resin, and carbon fluoride are suitable for production of ozone. For production of peroxides, the oxides of titanium, zirconium, niobium, and tantalum are suitable for use as electrolytic cocatalysts. For organic electrolytic oxidations, carbon, as well as those described above, is suitable.

The proportion of the dispersed particles containing $\beta$-lead dioxide powder in the total electrically deposited layer is preferably from 5 to 70 vol %. If less than 5 vol %, the effect of extension of surface area due to reduction in porosity is insufficient. On the other hand, if in excess of 70 vol %, the mechanical strength may be reduced.

The above particles can be incorporated in the lead dioxide electrically deposited layer by suspension plating in which electrodeposition is carried out by suspending $\beta$-lead dioxide powder and electrolytic cocatalyst particles in the above electrolytic solution. Alternatively, a paste containing the above particles is coated followed by electrodeposition of lead dioxide and this process may be repeated.

The electrode catalyst of the present invention is formed on a substrate. Depending on the type of the substrate, the catalyst can have various forms. When a conventional electrode substrate such as titanium is used as the substrate, the electrode catalyst of the present invention is formed on the surface thereof to provide an electrode structure; when an ion exchange membrane is used as the substrate, the electrode catalyst can be used as a SPE type electrode catalyst; when an electric collector is used as the substrate, the electrode catalyst of the present invention is used as, for example, a zerogap-type electrode in which the catalyst layer is brought into close contact with an ion exchange membrane; and when fine particle nuclei are used as the substrate, lead dioxide is electrically deposited on the nuclei surface to form catalyst particles.

In the case where a substrate merely for allowing lead dioxide to be electrically deposited thereon is used, the electrically deposited layer is peeled apart from the substrate and can be used as such or after pulverization in various electrode reactions. The catalyst, in such form, is particularly suitable for use in production of ozone by water electrolysis, in production of peroxides by electrolysis or aqueous solutions, and in organic electrolytic oxidation such as decomposition of phenol, nitrile, and the like.

In the electrode catalyst of the present invention, a lead dioxide electrically deposited layer in which fine particles containing $\beta$-lead dioxide powder is dispersed, is formed on a substrate. As electrode active substances, the $\beta$-lead dioxide powder has a higher overvoltage (by about 500 mV) than the platinum group metal oxides and the like. Thus, the electrode catalyst of the present invention is useful for production of ozone by electrolysis of water, production of peroxides by electrolysis of aqueous solutions, organic electrolytic oxidation and other electrolysis, which are carried out at high electrolytic overvoltage as compared to the electrolysis of alkali halide for the production of alkali hydroxide and electrolysis of water to form oxygen and hydrogen.

Since the electrically deposited layer has a three dimensional extension, the contact between a reactant and the electrode active substance is increased, which increases current efficiency and decreases cell voltage.

Since the electrically deposited layer contains particles, the degree of porosity can be adjusted by varying the density of the deposited layer and the degree of gas removal can, thus, be controlled. An apparatus suitable for gas removal can be readily assembled.

Since the lead dioxide layer is more densly formed on the substrate by electrodeposition, the electrolytically deposited layer is stronger than a lead dioxide catalyst layer formed by the conventional hot press method. Furthermore, the electrolytic voltage can be decreased.

The following are non-limiting examples of the present invention.

EXAMPLE 1

An expanded mesh made of pure titanium and having a thickness of 1.5 mm was smoothed and attached by resistance welding to a mesh also made of titanium having a thickness of 0.3 mm. This assembly served as a substrate. This substrate was degreased and washed in a boiling 20% aqueous hydrochloric acid solution. After the above pretreatment, an aqueous hydrochloric acid solution containing platinum: titanium: tantalum in proportions of 50:40:10 (mol %) respectively was applied to the surface of the substrate using a brush. The coated assembly was baked at 550° C. for 10 minutes in flowing air to provide an oxide underlying layer of platinum-titanium-tantalum. This operation was repeated four times.

On the above underlying layer, a lead dioxide layer containing β-lead dioxide powder was electrically deposited under the following conditions.

An aqueous lead nitrate solution was first electrolyzed to form β-lead dioxide, which was then ground for 24 hours in an agate mortar and screened to collect particles having a diameter of not greater than 100 μ.

An aqueous electrodeposition solution containing 400 g/l of lead nitrate was prepared, and the above screened β-lead dioxide powder was added thereto in an amount of 3 wt %. While the electrodeposition solution was vigorously stirred so as not to precipitate the β-lead lead dioxide particles, electrolysis was carried out for about 4 hours using the substrate with the underlying layer provided thereon as an anode at a current density of 4 A/dm$^2$ to form a coating on the substrate having an apparent thickness of about 2 mm. During electrolysis, the temperature was 65° C. and the pH of the solution was 1 to 2.

For comparison, as a coating layer was formed in the same manner as above except that β-lead dioxide particles were not suspended in the aqueous lead nitrate solution. The apparent thickness of the coating layer was about 0.8 mm, and the increase in the weight following electrolytic coating was about one-half. Thus, it was found that the particle content in the coating layer previously prepared using the β-lead dioxide particle-suspended electrodeposition solution was about 50 wt % of the total coating, and the coating layer was porous.

With the substrate in close contact with a perfluorosulfonic acid type ion exchange membrane, (manufactured by du Pont and sold under the trademark "Nafion") where the substrate served as an anode and a platinum net served as a cathode, electrolysis was carried out at a temperature of 10° C. and a current density of 100 A/dm$^2$ using a mixture of 5% hydrofluoric acid and a 15% aqueous sulfuric acid solution as an electrolyte. In the case of the electrode having electrically deposited β-lead dioxide, the current efficiency and electrolytic voltage in the generation of ozone were 16% and 3.6 V, respectively. In the case of the comparative electrode, the current efficiency and the electrolytic voltage were 10% and 4.2 V, respectively.

COMPARATIVE EXAMPLE 1

A substrate having an underlying layer was produced in the same manner as in Example 1. On the substrate, β-lead dioxide powder having a diameter of 20 to 100 μ was hot pressed for 10 minutes under a pressure of 100 kg/cm$^2$ at a temperature of 120° C. to form a lead dioxide attached layer.

Using the electrode substrate with the hot pressed layer, ozone production was carried out under the same conditions as in Example 1. The current efficiency and the electrolytic voltage were 8% and 5 V, respectively.

EXAMPLE 2

On a titanium substrate having an underlying layer as produced in the same manner as in Example 1, a β-lead dioxide layer was formed at 70° C. for 30 minutes at a current density of 4 A/dm$^2$ using 400 g/l of an aqueous lead nitrate solution as an electrolyte. Thereafter, using a mixture of 10 ml/l of an aqueous polytetrafluoroethylene (PTFE) suspension and 400 g/l of an aqueous lead nitrate solution with β-lead dioxide fine particles suspended therein as an electrolyte, a β-lead dioxide layer was electrically deposited on the above substrate at 70° C. for 30 minutes at a current density of 4 A/dm$^2$. The above two operations were each repeated four times to obtain a coating having a thickness of about 1.5 mm.

The electrode with the coating provided thereon was brought into close contact with a perfluorosulfonic acid type ion exchange membrane. Using the resulting substrate assembly as an anode, electrolysis was carried out at a current density of 100 A/dm$^2$ using an aqueous sulfuric acid solution containing a small amount of silicafluoric acid as an electrolyte. For comparison, electrolysis was carried out under the same conditions as above using the same comparative electrode as described in Example 1.

For the electrode of this example comprising an electrically deposited layer of β-lead dioxide and PTFE cocatalyst, the current efficiency for generation of ozone at the anode was 16%. On the other hand, in the case of the comparative electrode, the current efficiency was 8%.

EXAMPLE 3

An electrode with an electrically deposited lead dioxide layer coated thereon was produced in the same manner as in Example 1 except that β-lead dioxide powder containing 10 vol % zirconium oxide and passing through a 250 mesh screen was used in place of the β-lead dioxide powder.

Using a 5 cm ×5 cm electrode thus prepared as an anode, 3 liters of a gold plating waste containing 5,000 ppm of cyan was electrolyzed at a current density of 10 A/dm$^2$ to decompose cyan ions. For comparison, electrolysis was carried out using a platinum plated titanium electrode as an anode.

After 10 minutes of electrolysis, the concentration of cyan in the waste was decreased to 500 ppm in the case of the present electrolysis. On the other hand, the cyan concentration in the comparative electrolysis was 2,200 ppm.

EXAMPLE 4

The surface of a commercially available perfluorosulfonic acid type cation exchange membrane (manufactured by du Pont and sold under the trade name "Nafion 117") was roughened using #1000 emery paper. The ion exchange membrane was then dipped in a 5 wt % aqueous solution of nitric acid to convert the sulfonic-acid group thereof into the H type. This ion exchange membrane was incorporated in a two chamber electrolytic cell as a diaphragm. In one of the chambers, 5 g/l of an aqueous solution of chloroplatinic acid was introduced, and in the other chamber, 10 g/l of an aqueous hydrazine solution was introduced. By allowing the solutions to stand for 24 hours, a platinum layer was formed on one side of the diaphragm.

Independently, β-lead dioxide prepared by the electrolytic method of the present invention was ground in an agate mortar. The fine particles of β-lead dioxide obtained by passing through a 250 mesh screen were kneaded in combination with an aqueous PTFE suspension (produced by Mitsui Fluorochemical Co., Ltd.

under the trade name "30J"; PTFE content 1 wt %) and a perfluoro ion exchange resin to prepare a paste. This paste was brush coated on the opposite side of the membrane on which the platinium was deposited, allowed to stand, smoothed and then heat pressed at a temperature of 160° C. to form a lead dioxide attached layer.

The ion exchange membrane thus-prepared with platinum attached on one side and β-lead dioxide on the other was again placed into the two chamber electrolytic cell. In the chamber facing the β-lead dioxide side at the membrane, 400 g/l of an aqueous lead nitrate solution was introduced. Using the platinum on the ion exchange membrane as a cathode and a titanium plate placed in contact with the β-lead dioxide attached layer as an anode, electrolysis was carried out for 2 hours at 60° C. at 2 A/dm$^2$ to form an electrically deposited lead dioxide layer.

Electric collectors of porous nickel with platinum plated on the surface thereof used at the cathode side, and a titanium mesh with β-lead dioxide coated thereon used at the anode (lead dioxide) side were placed in contact with the above electrode structure. Deionized water was introduced in at the anode side and electrolyzed. At 20° C., and a current density 100 A/dm$^2$, oxygen gas containing 14% ozone was obtained. The cell voltage during electrolysis was 3.7 V.

COMPARATIVE EXAMPLE 2

Ozone was generated under the same conditions as in Example 4, using an ion exchange membrane in which the formation of an electrically deposited layer using an aqueous lead nitrate solution was omitted. Only the lead dioxide attached layer was formed. Oxygen gas containing 9% ozone was obtained. The cell voltage during electrolysis was 5.1 V.

EXAMPLE 5

An ion exchange membrane with platinum attached to one side thereof was prepared in the same manner as in Example 4. β-lead dioxide passing through a 345 mesh screen was kneaded with ethyl alcohol to prepare a paste. This paste was coated on the opposite side of the ion exchange membrane relative to the platinium-deposited side, dried at room temperature, smoothed and then pressed at a temperature of 160° C. Furthermore, a lead dioxide electrically deposited layer was formed by electrolysis in the same manner as in Example 1. The solid electrolyte single electrode structure thus produced was incorporated in the same electrolytic cell as in Example 1, and deionized water was introduced in the anode chamber and electrolyzed. Under conditions of temperature 20° C. and current density 100 A/dm$^2$, oxygen gas containing 12% ozone was obtained. The cell voltage during electrolysis was 4.2 V.

EXAMPLE 6

The ion exchange membrane of Example 4 was activated by sputtering argon ions to the surface thereof. The ion exchange membrane was converted into the H type by dipping in a 5 wt % aqueous nitric acid solution and then incorporated as the diaphragm of the two chamber electrolytic cell. A platinum coating was formed on one side in the same manner as in Example 4.

β-lead dioxide fine particles obtained by electrolysis and a mixture of titanium oxide and zirconium oxide particles were treated in vacuum at 1,100° C. for 6 hours to obtain partially reduced fine particles. These particles were kneaded with an aqueous PTFE suspension to prepare a paste. This paste was coated on the ion exchange membrane in the same manner as in Example 1 to form an attached layer.

The ion exchange membrane thus prepared was incorporated in the two chamber electrolytic cell. At the β-lead dioxide layer side, 400 g/l of an aqueous lead nitrate solution containing a suspension of fine particles of the same composition as the paste was introduced. At 65° C. and 2 A/dm$^2$, an electrically deposited layer of β-lead dioxide containing the above fine particles was formed on the attached layer containing β-lead dioxide to thereby produce a solid electrolyte type electrode structure.

The electrode structure thus prepared was incorporated in an electrolytic cell in the same manner as in Example 4, and deionized water was electrolyzed. At 20° C. and a current density 100 A/dm$^2$,oxygen gas containing 16% of ozone was obtained from the anode compartment. The cell voltage during electrolysis was 3.6 V.

EXAMPLE 7

A fine mesh (long diameter: 2.5 mm; short diameter: 1.6 mm) having a thickness of 0 3 mm was welded to the surface of an expanded mesh of pure titanium having a thickness of 1.5 mm to form an electric collector. This electric collector was welded to a flange made of titanium plate. This welded assembly was degreased and washed with a boiling 20 wt % aqueous hydrochloric acid solution for 3 minutes to carry out pre-treatment. A coating of platinum-titanium-tantalum in proportions of 25-60-15 mol % respectively was then formed on the titanium plate by the thermal decomposition method of Example 1 to form an underlying oxide layer.

Using a solution of lead oxide in a 30 wt % aqueous sodium hydroxide solution as an electrolyte and the titanium mesh with the underlying layer formed thereon as an anode, electrolysis was carried out for 30 minutes at 40° C. and a current of 1 A/dm$^2$ to form a coating layer of α-lead dioxide on the above electric collector.

A commercially available perfluorosulfonic acid type cation exchange membrane (Nafion 117), the surface of which-was roughened with #1000 emery paper, was used as a solid electrolyte. On one side of the ion exchange membrane, a solution prepared by dissolving chloroplatinic acid in isopropyl alcohol (platinum content 50 g/l) was applied using a brush. The solution thus applied was thermally decomposed at 250° C. to form a platinum coating layer on one side of the membrane.

The ion exchange membrane was placed in a two chamber electrolytic cell. At the platinum side, porous nickel (manufactured by Sumitomo Electric industries, Ltd. and sold under the trade name "Celmet") with platinum applied thereon was employed as an electric collector. At the opposite chamber, the electric collector produced as described above was placed in contact with the above ion exchange membrane β-lead dioxide powder prepared by electrolysis and passed through a 250 mesh screen was suspended in an aqueous lead nitrate solution and PTFE was further added thereto in an amount of 1 wt %. Using 400 g/l of the above aqueous lead nitrate solution as an electrolyte with the above titanium electric collector as an anode and the platinum coated nickel as a cathode, electrolysis was carried out at a current density of 2 A/dm$^2$ and a temperature of 60° C.

After 8 hours of electrolysis, a porous lead dioxide electrically deposited layer having the total thickness of about 2 mm was formed. In the lead dioxide electrically deposited layer, as well as in the dispersed β-lead dioxide, white fibers considered to be PTFE were observed. The ion exchange membrane and the electric collector were combined together with the lead dioxide layer to form an assembly.

The assembly was washed, and deionized water was placed in the electrolytic cell. With the lead dioxide layer side as an anode, electrolysis was carried out at 20° C. and a current density of 100 A/dm$^2$. From the anode side, oxygen containing 14% ozone was obtained. The cell voltage during electrolysis was 3.6 V.

COMPARATIVE EXAMPLE 3

Upon production of ozone under the same conditions as in Example 7 omitting the formation of the electrically deposited layer using the aqueous lead nitrate solution and wherein the electric collector-attached layer-ion exchange membrane were combined into one body by the hot pressing, oxygen gas containing 8% ozone was obtained. The cell voltage during electrolysis was 6 V.

EXAMPLE 8

In the same manner as provided in Example 7, an ion exchange membrane with platinum attached to the one side thereof and an anode collector with an underlying layer provided thereto were prepared. The ion exchange membrane was incorporated in this chamber electrolytic cell. The anode collector with an β-lead dioxide layer formed thereon was placed at a distance of 0.5 to 1 mm from the ion exchange membrane. In the anode compartment, a 400 g/l aqueous lead nitrate solution was introduced containing a suspension of β-lead dioxide powder seived through a 200 mesh screen and as obtained by electrolysis. Using the anode collector as an anode and placing a platinum collector prepared in Example 7 as a cathode, electrolysis was carried out for 6 hours at 60° C. and a current density of 4 A/dm$^2$. An electrode assembly in which the anode collector and the ion exchange membrane were combined into one body by the lead dioxide electrically deposited layer was thus obtained.

Deionized water was introduced in both the anode compartment and the cathode compartment of the electrolytic cell and electrolyzed at 20° C. and 100 A/dm$^2$ to obtain oxygen gas containing 14% of ozone. The cell voltage during electrolysis was 3.7 V.

EXAMPLE 9

An ion exchange membrane subjected to pretreatment in the same manner as in Example 7 was incorporated in a two chamber electrolytic cell as a diaphragm. In one compartment, a 5 g/l aqueous chloroplatinic acid solution was introduced, and in the other compartment, a 10 g/l aqueous hydrazine solution was introduced. After 24 hours, a platinum layer was thus formed on one side of the ion exchange membrane.

The ion exchange membrane was thoroughly washed and incorporated in a two chamber electrolytic cell as a diaphragm. Porous nickel with a platinum coating formed thereon was placed in contact with the platinum membrane layer. At the other compartment, an electric collector with a lead dioxide layer formed on the surface thereof as fabricated in Example 1 was placed in contact with the ion exchange membrane.

In the electrolytic compartment at the opposite side of the platinum layer, a 400 g/l aqueous lead nitrate solution containing 10 g/l of β-lead oxide and 10 ml/l of a perfluoro ion exchange resin solution was introduced. An electric potential was applied to the electric collectors with the platinum side serving as the cathode for 4 hours at a current density of 4 A/dm$^2$. A lead dioxide layer containing particles mainly (80 wt % or more) of β-lead dioxide particles was electrically deposited, to form an electrode assembly in which the ion exchange membrane and the anode collector were combined together into one unit.

The electrolytic solution was withdrawn from the electrolytic cell and the cell was then thoroughly washed. Then, deionized water was introduced into the cell as an electrolytic solution. Electrolysis was carried out at a current density of 100 A/dm$^2$. From the anode compartment, oxygen gas containing 16% ozone was obtained. The cell voltage during electrolysis was 3.6 V.

EXAMPLE 10

An electrolytic assembly was produced in the same manner as in Example 9 except that a mixture of β-lead dioxide and carbon fluoride was used as the suspension. The electrolytic assembly was incorporated in an electrolytic cell, and deionized water was introduced in the anode compartment and electrolyzed at 50 A/dm$^2$. From the anode compartment, oxygen gas containing about 9% ozone was obtained. The cell voltage during electrolysis was 3.3 V.

EXAMPLE 11

A commercially available perfluorosulfonic acid type cationic exchange membrane (Nafion 117), after roughening the surface thereof with #1000 emery paper, was dipped in a 5 wt % aqueous nitric acid solution to convert the sulfonic acid group into the H type and then incorporated in a two chamber electrolytic cell as a diaphragm. In one compartment, a 5 g/l aqueous chloroplatinic acid solution was introduced, and in the other compartment, a 10 g/l aqueous hydrazine solution was introduced. The solutions were then allowed to stand to form a platinum layer on one side of the membrane.

β-lead dioxide prepared by the electrolytic method of Example 1 was ground in an agate mortar to obtain a powder seived through a 250 mesh screen. This powder was kneaded along with an aqueous PTFE suspension (30J) and a perfluoro ion exchange resin to form a paste. This paste was applied with a brush on the side of the ion exchange membrane opposite to the side on which platinum was deposited. The applied paste was allowed to stand at room temperature and smoothed and then heat pressed at a temperature of 160° C. to form an attached layer.

An electric collector on which an underlying layer had been formed in the same manner as in Example 7 was coated with α-lead dioxide in the same manner as in Example 7.

The above ion exchange membrane was incorporated in a two chamber electrolytic cell. Porous nickel with platinum-coated thereon (Celmet) was brought into close contact with the platinum side of the ion exchange membrane. At the other side, the above prepared electric collector was brought into close contact with the β-lead dioxide attached layer on the ion exchange membrane. A 400 g/l aqueous lead nitrate solution was added to the lead dioxide side, and electrolysis was carried out for 4 hours at a current density of 4 A/dm2 using the titanium electric collector coated with lead dioxide as an anode. An electrode assembly was thus obtained in which the ion exchange membrane and the electric collector were combined together in one unit.

The electrolytic solution was withdrawn from the electrolytic cell, and the cell was then thoroughly washed with deionized water. Deionized water was then added to the lead dioxide compartment and electricity was passed therethrough at a current density of 100 A/dm$^2$. The liquid temperature was 20° C. and the electrolytic voltage was 3.6 V. Oxygen gas containing 16% ozone was thus obtained from the anode side.

EXAMPLE 12

An electrode assembly was produced in the same manner as an Example 11 except that a mixture of a 1 g/l aqueous suspension of PTFE and a 400 g/l aqueous lead nitrate solution containing β-lead dioxide fine particles containing tantalum oxide was used as the electrolytic solution in formation of the electrically deposited lead dioxide layer.

The electrode assembly thus formed was incorporated into a two chamber electrolytic cell. Deionized water was added to the lead dioxide chamber and electrolysis was carried at a current density of 100 A/dm$^2$ using the lead dioxide as the anode. The electrolytic voltage was 3.5 V, and oxygen gas containing 15% ozone was obtained from the anode side.

While the invention has been described in detail and with reference to specific embodiments thereof, it will be apparent to one skilled in the art that various changes and modifications can be made therein without departing from the spirit and scope thereof.

What is claimed is:

1. An electrode catalyst comprising a lead dioxide electrically deposited layer, said layer having particles containing β-lead dioxide powder dispersed therein.

2. An electrode catalyst as in claim 1, wherein the dispersed particles comprise a mixture of β-lead dioxide powder and electrolytic cocatalyst particles.

3. An electrode catalyst as in claim 2, wherein the electrolytic cocatalyst is at least one selected from the group consisting of polytetrafluoroethylene, agar, gelatin, a perfluoro ion exchange resin, carbon fluoride, carbon, and oxides of one or more of titanium, zirconium, niobium and tantalum.

4. An electrode catalyst as in claim 1, wherein the dispersed particles constitute from 5 to 70% by volume of the total lead dioxide electrically deposited layer.

5. An electrode catalyst comprising a substrate for electrodeposition and a lead dioxide electrically deposited layer on the substrate, said layer having particles containing β-lead dioxide powder dispersed therein.

6. An electrode catalyst as in claim 5, wherein the dispersed particles comprise a mixture of β-lead dioxide powder and electrolytic cocatalyst particles.

7. An electrode catalyst as in claim 6, wherein the electrolytic cocatalyst is at least one selected from the group consisting of polytetrafluoroethylene, agar, gelatin, a perfluoro ion exchange resin, carbon fluoride, carbon, and oxides of one or more of titanium, zirconium, niobium and tantalum.

8. An electrode catalyst as in claim 5, wherein the dispersed particles constitute from 5 to 70% by volume of the total lead dioxide electrically deposited layer.

9. An electrode catalyst as in claim 5, wherein the substrate for electrodeposition is an ion exchange membrane.

10. An electrode catalyst as in claim 5, wherein the substrate for electrodeposition is an electric collector.

11. An electrode catalyst as in claim 5, wherein the substrate for electrodeposition is a nucleus for the growth of the electrically deposited layer.

12. A method for producing a lead dioxide electrode catalyst, which comprises electrolyzing a substrate for deposition in an aqueous lead nitrate solution having particles containing β-lead dioxide powder suspended therein to form a lead dioxide electrically deposited layer on said substrate, said layer having particles containing β-lead dioxide powder dispersed therein; and thereafter separating the lead dioxide electrically deposited layer from the substrate.

13. A method for producing a lead dioxide electrode catalyst, which comprises electrolyzing a substrate for electrodeposition in an aqueous lead nitrate solution having particles containing β-lead dioxide powder suspended therein to thereby form a lead dioxide electrically deposited layer on said substrate, said layer having particles containing β-lead dioxide powder dispersed therein.

14. A method as in claim 13, wherein the substrate for electrodeposition is an ion exchange membrane.

15. A method as in claim 13, wherein the substrate for electrodeposition is an electric collector.

16. A method as in claim 13, wherein the substrate for electrodeposition is a nucleus for growth of the electrically deposited layer.

* * * * *